US007290582B2

(12) United States Patent
Lin

(10) Patent No.: US 7,290,582 B2
(45) Date of Patent: Nov. 6, 2007

(54) ROMAN SHADE HAVING SUSPENSION STRUCTURE

(76) Inventor: Ke-Min Lin, 18, Tai San 2 St., Fu Quan Li, Jiayi (TW)

( * ) Notice: Subject to any disclaimer, the term of this patent is extended or adjusted under 35 U.S.C. 154(b) by 278 days.

(21) Appl. No.: 11/111,210

(22) Filed: Apr. 21, 2005

(65) Prior Publication Data

US 2006/0237145 A1 Oct. 26, 2006

(51) Int. Cl.
*A47H 1/00* (2006.01)

(52) U.S. Cl. ..... 160/330; 160/124

(58) Field of Classification Search ..... 160/84.01, 160/84.04, 124, 126, 330, 243; 16/87.4 R, 16/87.6 R, 95 D, 94 D, 96 D, 87.8
See application file for complete search history.

(56) References Cited

U.S. PATENT DOCUMENTS 2,074,928 A * 3/1937 Miller ..... 160/348
2,320,003 A * 5/1943 Madan ..... 16/87.8
4,115,899 A * 9/1978 Ford ..... 16/87.4 R
4,518,025 A * 5/1985 Judkins ..... 160/84.04
4,972,895 A * 11/1990 Meshaka ..... 160/330
6,543,516 B2 * 4/2003 Hwang ..... 160/84.01
6,564,851 B1 * 5/2003 Liao ..... 160/330
7,117,922 B2 * 10/2006 Tony ..... 160/330

* cited by examiner

*Primary Examiner*—David Purol
(74) *Attorney, Agent, or Firm*—Alan Kamrath; Kamrath & Associates PA

(57) ABSTRACT

A roman shade includes a headrail, a plurality of tracks each mounted on the headrail, a plurality of suspension members each mounted on a respective one of the tracks and each having an inside formed with a locking groove, and a shade cloth having an upper end extended through and detachably locked in the locking groove of each of the suspension members. Thus, the shade cloth is attached to the headrail by the tracks and the suspension members so that the shade cloth is combined with the headrail rigidly and stably.

8 Claims, 11 Drawing Sheets

ROMAN SHADE HAVING SUSPENSION STRUCTURE

BACKGROUND OF THE INVENTION

1. Field of the Invention

The present invention relates to a roman shade, and more particularly to a roman shade having a suspension structure.

2. Description of the Related Art

A conventional roman shade comprises a headrail, and a shade cloth having an upper end locked on the headrail. However, the shade cloth is fixed on the headrail so that the shade cloth cannot be detached from the headrail for replacement or cleaning.

Another conventional roman shade comprises a headrail having a first bonding strap, and a shade cloth having an upper end having a second bonding strap detachably bonded onto the first bonding strap of the headrail to attach the shade cloth to the headrail. However, the second bonding strap of the shade cloth is easily loosened from the first bonding strap of the headrail during a long-term utilization, so that the shade cloth is not attached to the headrail closely.

SUMMARY OF THE INVENTION

The primary objective of the present invention is to provide a roman shade having a suspension structure.

Another objective of the present invention is to provide a roman shade, wherein the shade cloth is attached to the headrail by the tracks and the suspension members so that the shade cloth is combined with the headrail rigidly and stably.

A further objective of the present invention is to provide a roman shade, wherein the shade cloth is mounted on and detached from the suspension members easily and rapidly, thereby facilitating a user replacing and cleaning the shade cloth.

Further benefits and advantages of the present invention will become apparent after a careful reading of the detailed description with appropriate reference to the accompanying drawings.

DETAILED DESCRIPTION OF THE INVENTION

Figure 1:
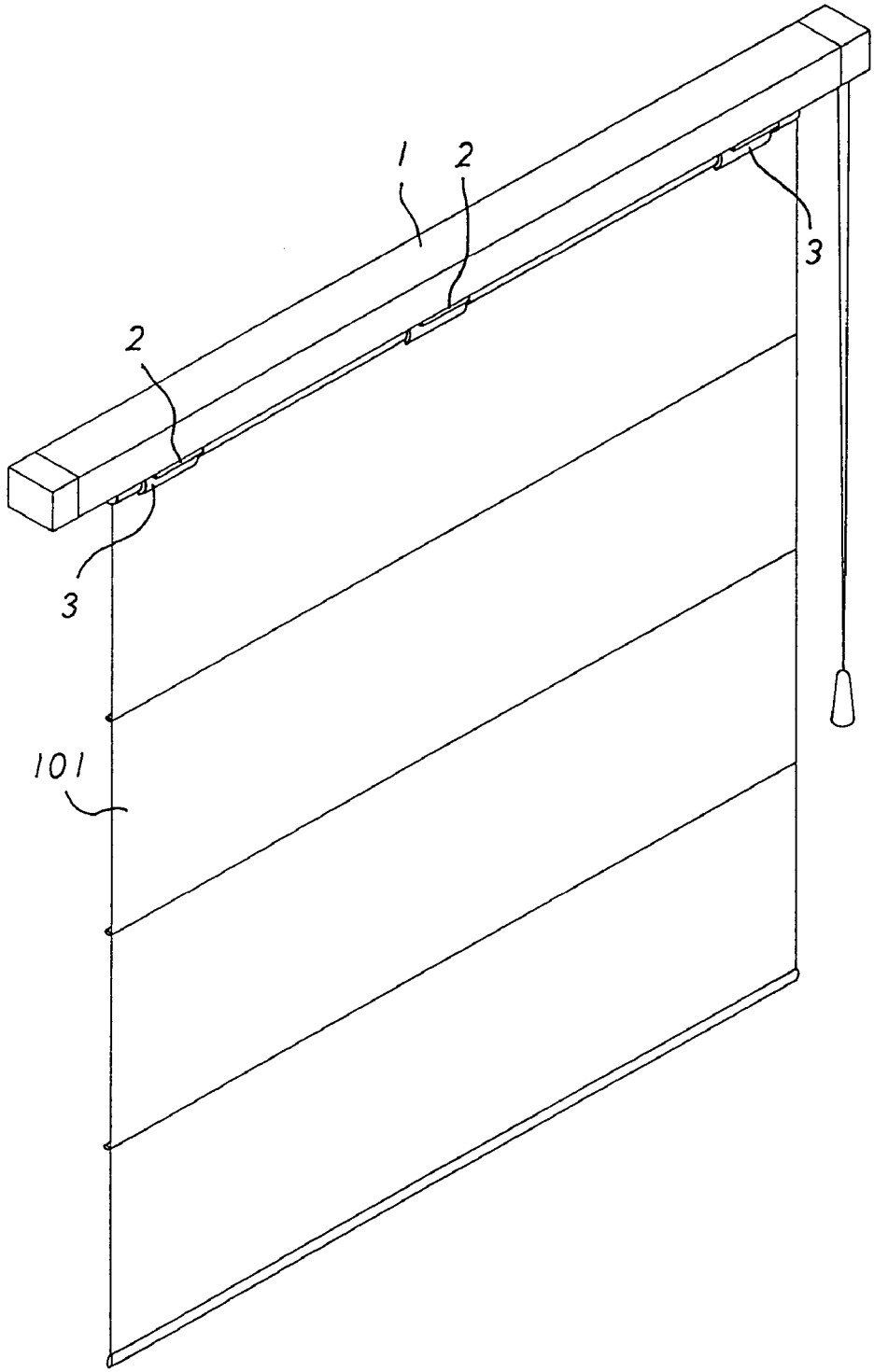
FIG. 1 is a perspective view of a roman shade in accordance with the preferred embodiment of the present invention.
Figure 2:
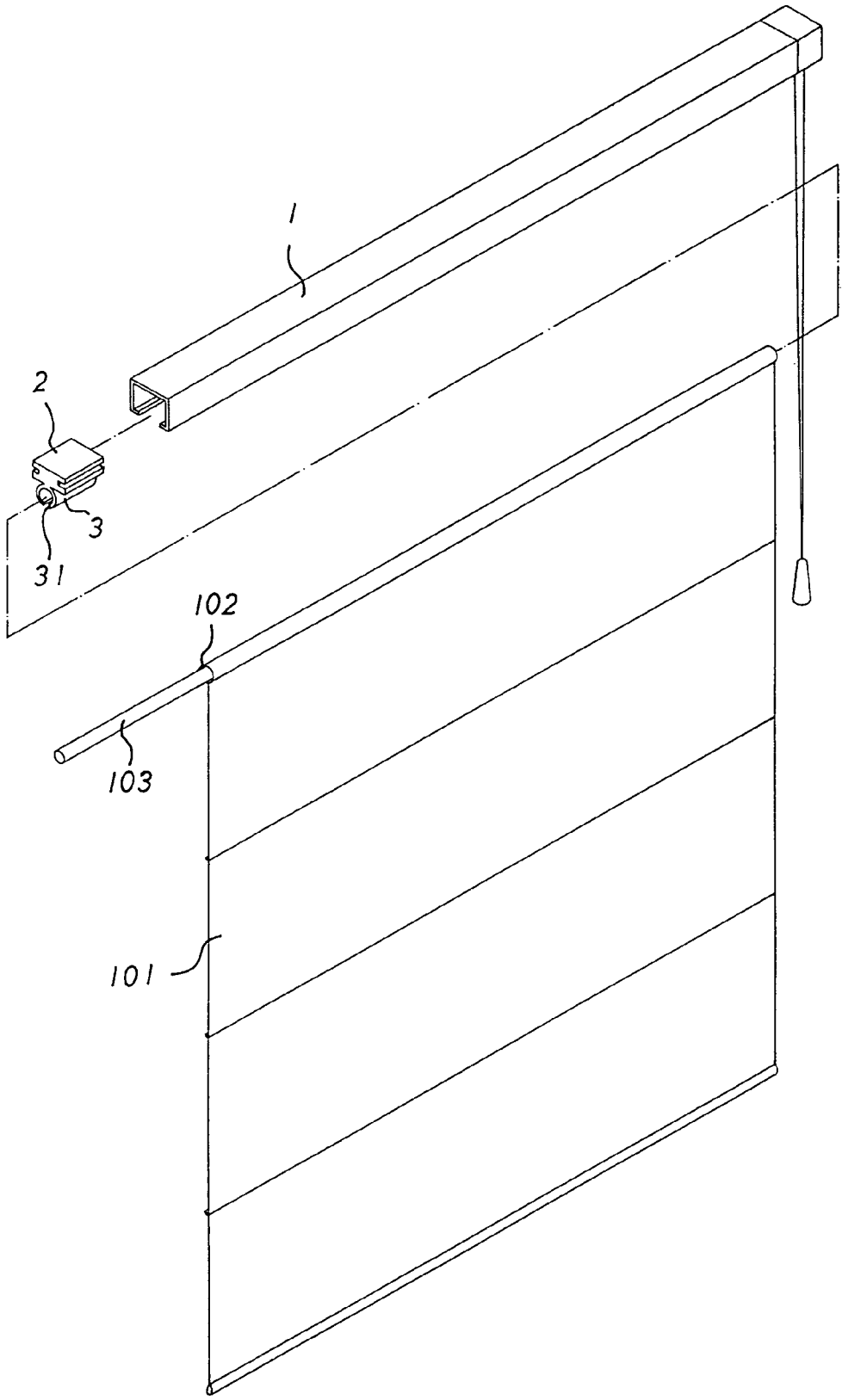
FIG. 2 is a partially exploded perspective view of the roman shade as shown in FIG. 1.

Referring to the drawings and initially to FIGS. 1 and 2, a roman shade 10 in accordance with the preferred embodiment of the present invention comprises a headrail 1, a plurality of tracks 2 each mounted on the headrail 1, a plurality of suspension members 3 each mounted on a respective one of the tracks 2 and each having an inside formed with a locking groove 31, and a shade cloth 101 having an upper end extended through and detachably locked in the locking groove 31 of each of the suspension members 3.

Preferably, the upper end of the shade cloth 101 is formed with a mounting portion 102 for mounting a shaft 103 which is detachably locked in the locking groove 31 of each of the suspension members 3. Thus, the shade cloth 101 is attached to the headrail 1 by the tracks 2 and the suspension members 3. Thus, the shade cloth 101 is mounted on and detached from the suspension members 3 easily and rapidly, thereby facilitating a user replacing and cleaning the shade cloth 101.

Figure 3:
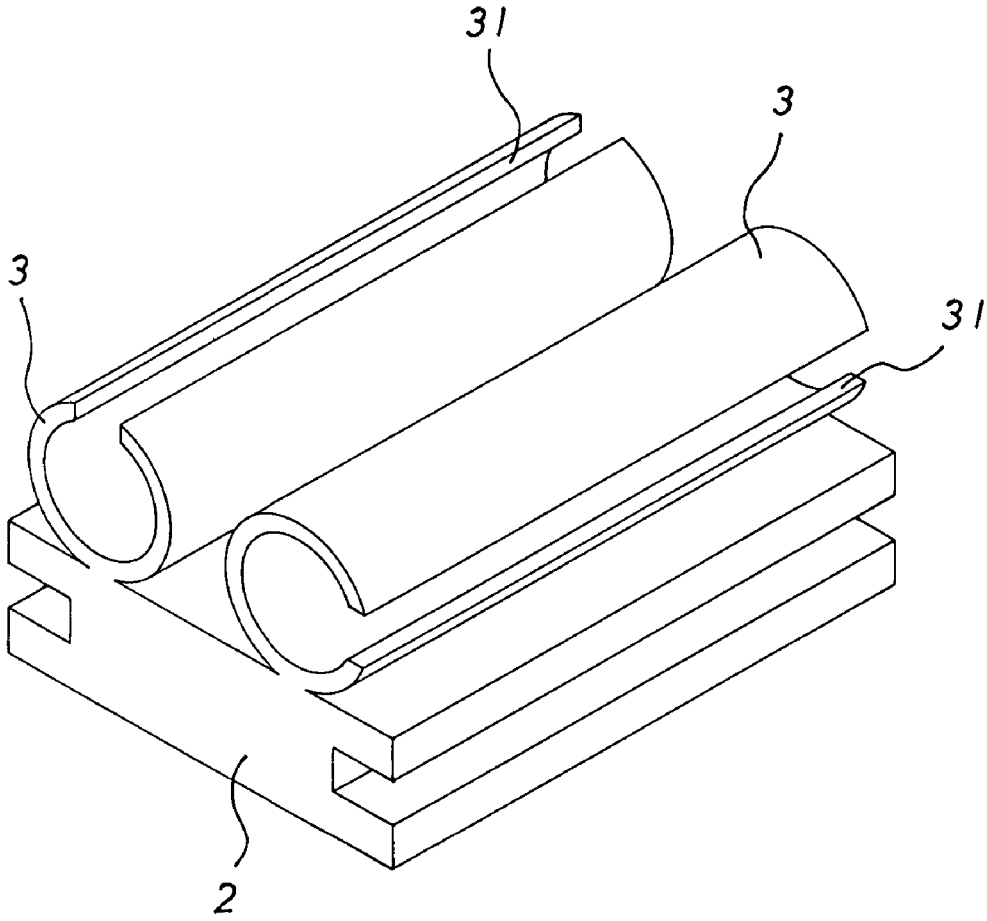
FIG. 3 is a perspective view of a track and a suspension member of a roman shade in accordance with another preferred embodiment of the present invention.

Referring to FIG. 3, each of the tracks 2 is integrally formed with the respective suspension member 3, thereby decreasing costs of fabrication. In addition, each of the tracks 2 is provided with a plurality of juxtaposed suspension members 3 for suspending a plurality of shade cloths 101. The locking groove 31 of each of the suspension members 3 is substantially C-shaped and has an opening facing downward or sideward.

Figure 4:
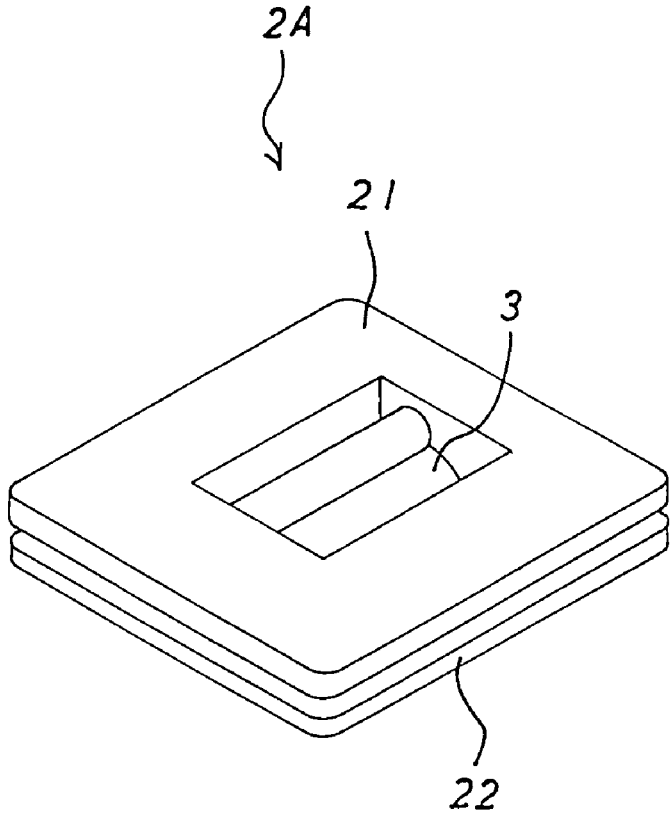
FIG. 4 is a perspective view of a track and a suspension member of a roman shade in accordance with another preferred embodiment of the present invention.
Figure 5:
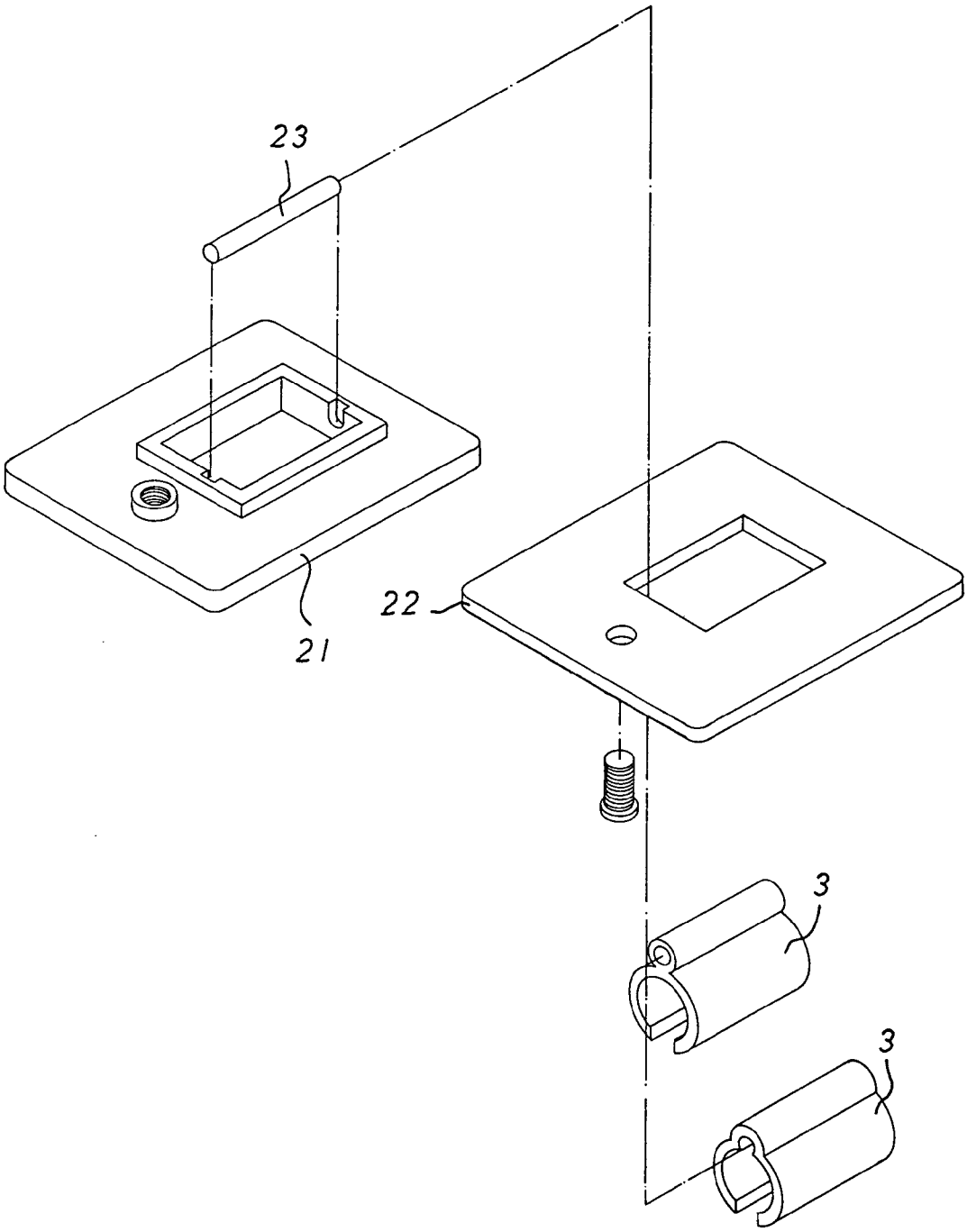
FIG. 5 is an exploded perspective view of the track and the suspension member of the roman shade as shown in FIG. 4.

Referring to FIGS. 4 and 5, each of the tracks 2A includes an upper plate 21, a lower plate 22 combined with the upper plate 21, and a pivot shaft 23 mounted between the upper plate 21 and the lower plate 22 and extended through the respective suspension member 3. Thus, each of the suspension members 3 is pivotally mounted on a respective one of the tracks 2A by the pivot shaft 23, so that the shade cloth 101 is pivotable relative to the headrail 1 by a pivot action between the suspension members 3 and the tracks 2A. In addition, each of the suspension members 3 is pivotable relative to the headrail 1 to align the locking groove 31 with the shaft 103 of the shade cloth 101, thereby facilitating the user mounting the shade cloth 101.

Figure 6:
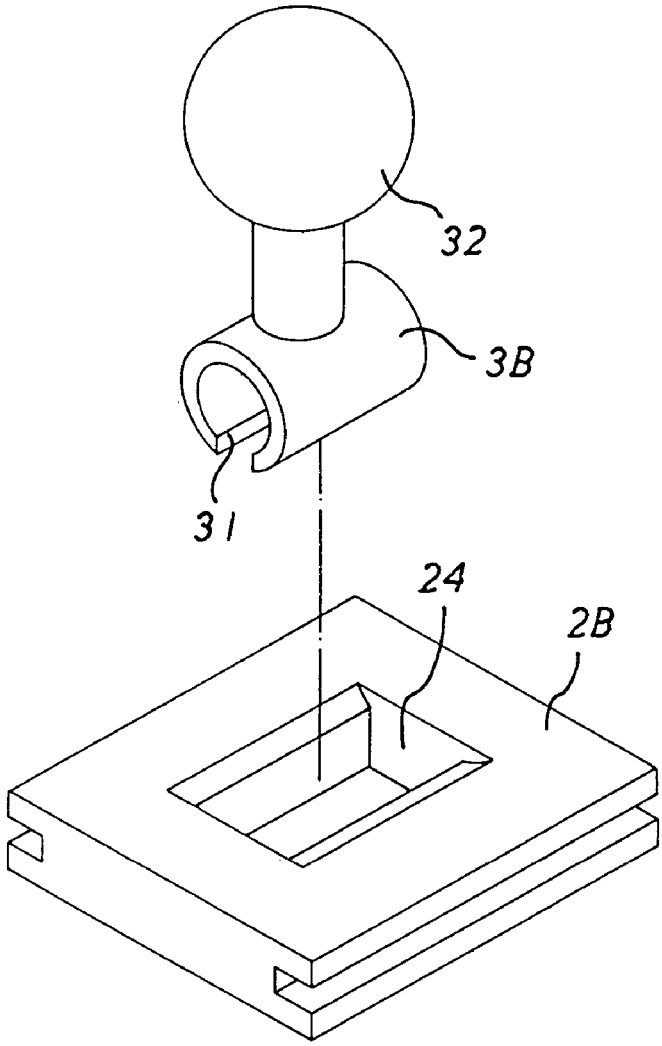
FIG. 6 is an exploded perspective view of a track and a suspension member of a roman shade in accordance with another preferred embodiment of the present invention.

Referring to FIG. 6, each of the tracks 2B has an inside formed with a pivot hole 24, and each of the suspension members 3B is protruded outward from the pivot hole 24 of the respective track 2B and has a periphery provided with a spherical pivot portion 32 pivotally mounted in the pivot hole 24 of the respective track 2B. Preferably, the pivot portion 32 is integrally formed on each of the suspension members 3B. Thus, each of the suspension members 3B is pivotable relative to the respective track 2B.

Figure 7:
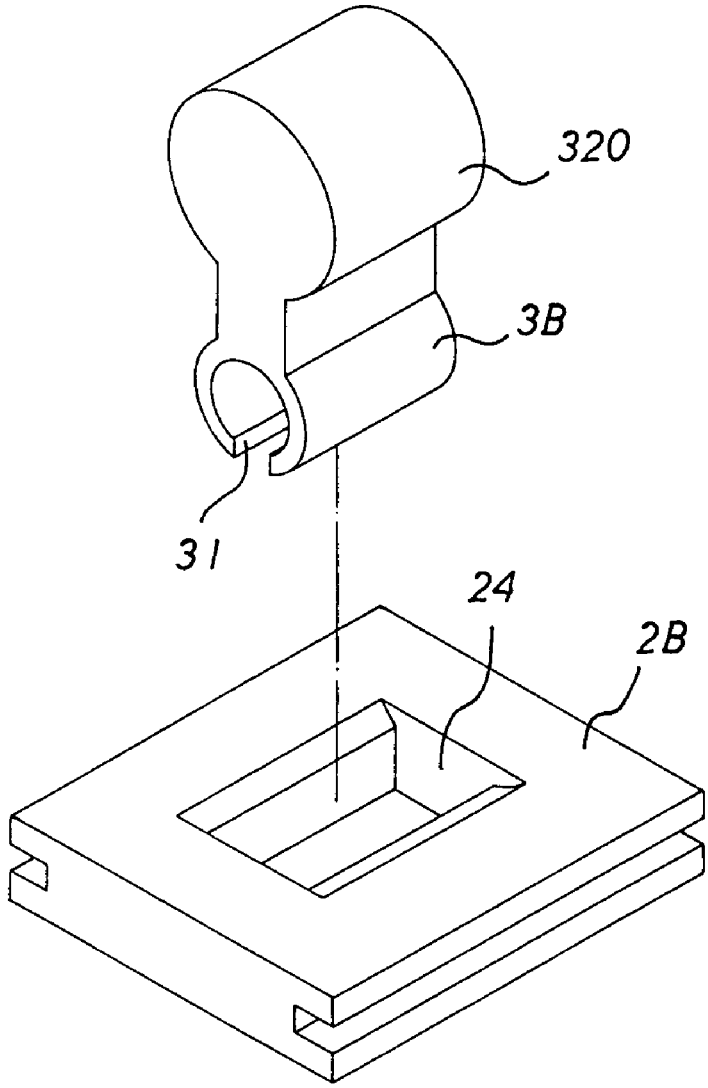
FIG. 7 is an exploded perspective view of a track and a suspension member of a roman shade in accordance with another preferred embodiment of the present invention.

Referring to FIG. 7, each of the suspension members 3B has a periphery provided with an arc-shaped pivot portion 320. Preferably, the pivot portion 320 is integrally formed on each of the suspension members 3B.

Figure 8:
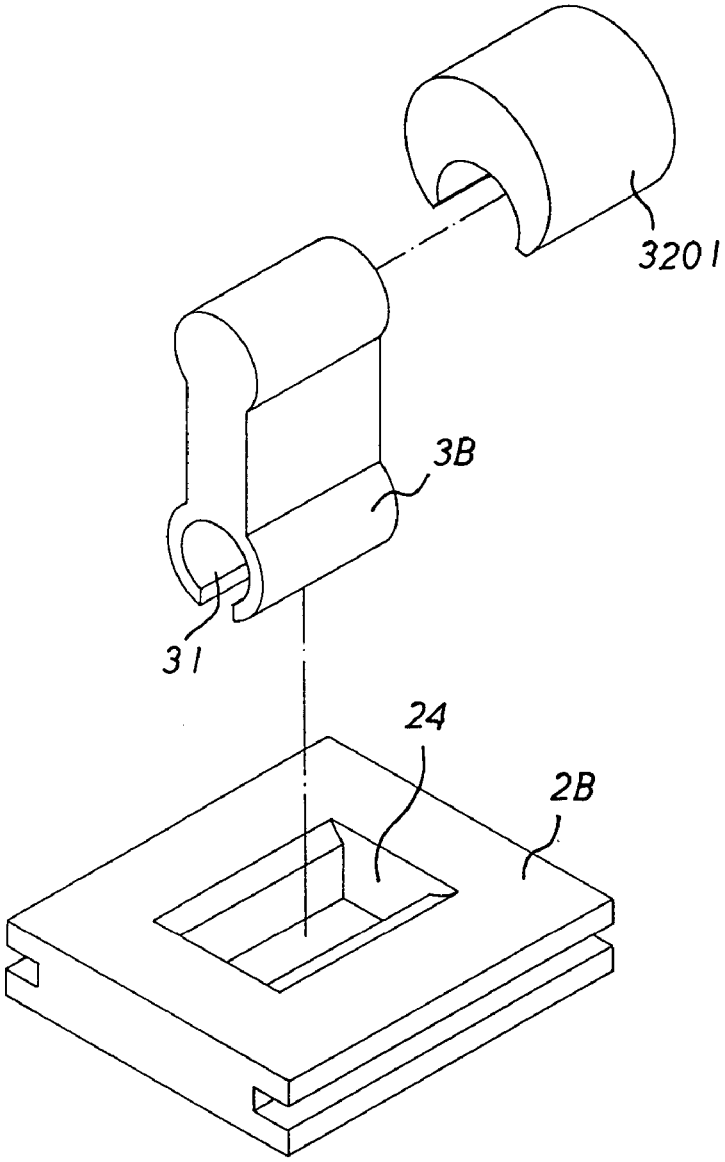
FIG. 8 is an exploded perspective view of a track and a suspension member of a roman shade in accordance with another preferred embodiment of the present invention.

Referring to FIG. 8, the pivot portion 3201 is detachably mounted on each of the suspension members 3B.

Figure 9:
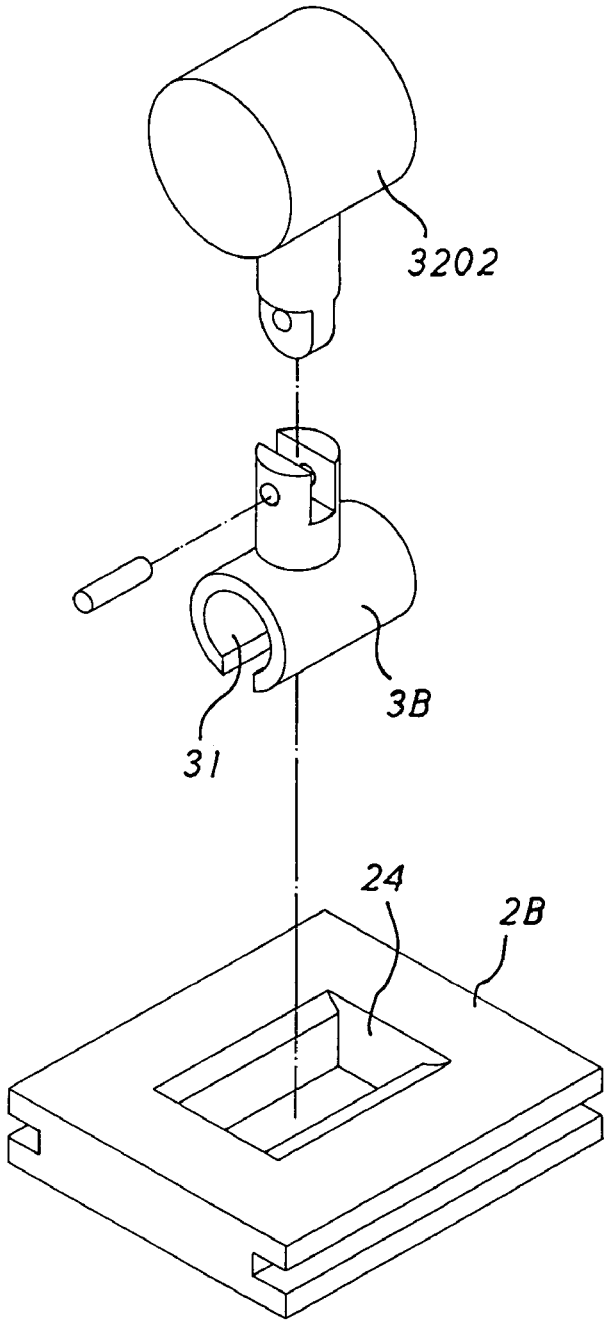
FIG. 9 is an exploded perspective view of a track and a suspension member of a roman shade in accordance with another preferred embodiment of the present invention.

Referring to FIG. 9, the pivot portion 3202 is pivotally mounted on each of the suspension members 3B.

Figure 10:
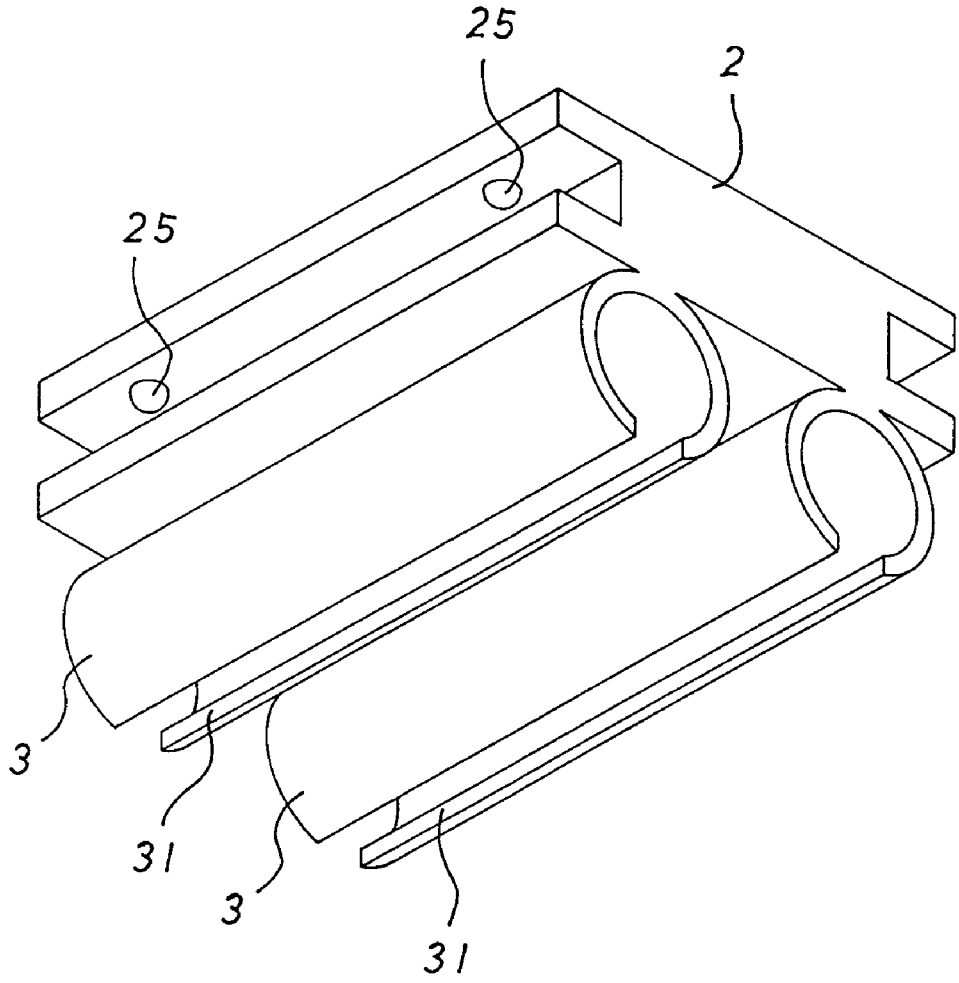
FIG. 10 is a perspective view of a track and a suspension member of a roman shade in accordance with another preferred embodiment of the present invention.

Referring to FIG. 10, each of the tracks 2 is provided with a plurality of protruding bosses 25 rested on a side of the headrail 1 to decrease the friction between each of the tracks 2 and the headrail 1.

Figure 11:
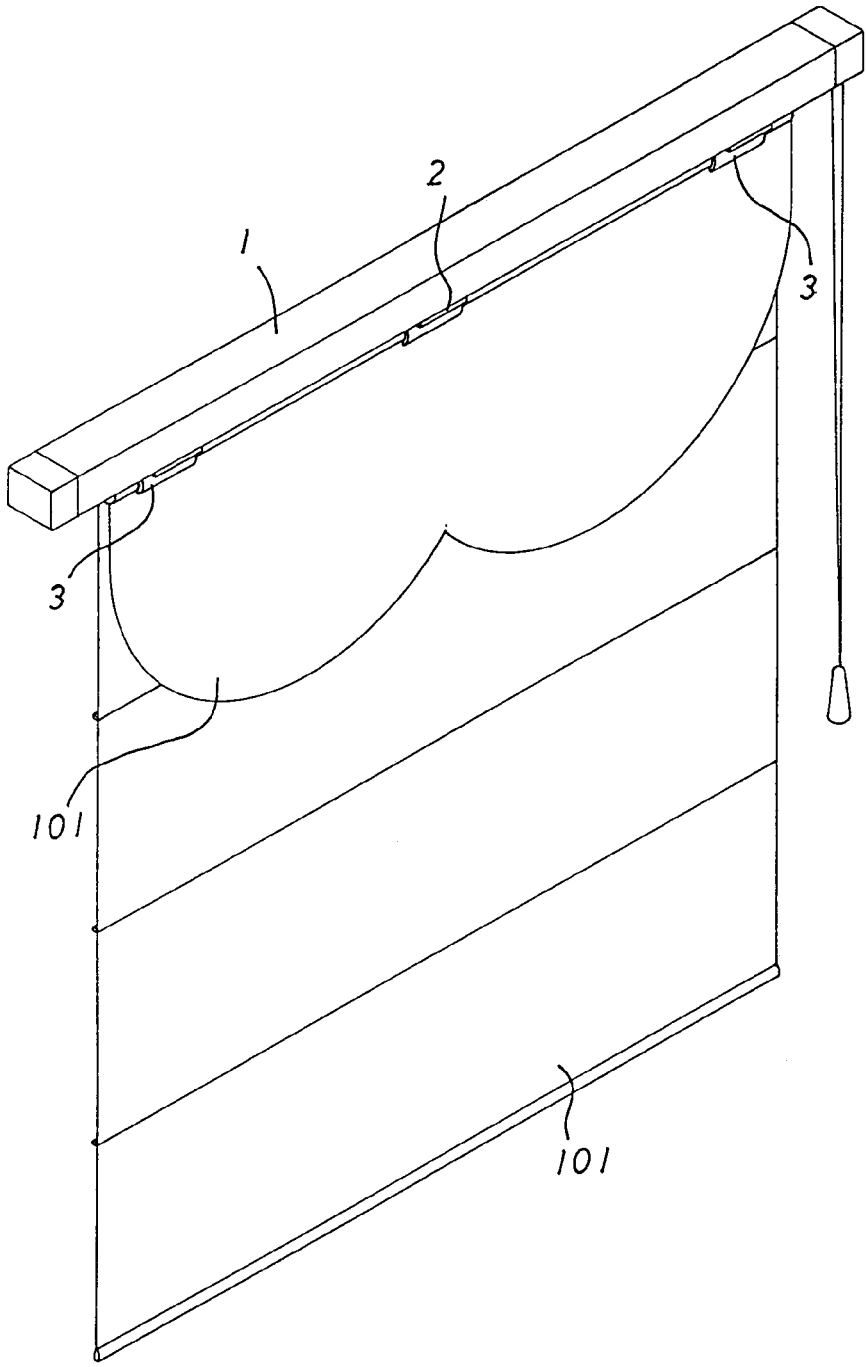
FIG. 11 is a perspective view of a roman shade in accordance with another preferred embodiment of the present invention.

Referring to FIG. 11, the shade cloth 101 has another form.

Accordingly, the shade cloth 101 is attached to the headrail 1 by the tracks 2 and the suspension members 3 so that the shade cloth 101 is combined with the headrail 1 rigidly and stably. In addition, the shade cloth 101 is mounted on and detached from the suspension members 3 easily and rapidly, thereby facilitating a user replacing and cleaning the shade cloth 101.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A roman shade, comprising:

a headrail;

a plurality of tracks each mounted on the headrail;

a plurality of suspension members each mounted on a respective one of the tracks and each having an inside formed with a locking groove; and a shade cloth having an upper end extended through and detachably locked in the locking groove of each of the suspension members;

wherein each of the tracks includes an upper plate, a lower plate combined with the upper plate, and a pivot shaft mounted between the upper plate and the lower plate and extended through the respective suspension member so that each of the suspension members is pivotally mounted on a respective one of the tracks by the pivot shaft.

2. The roman shade in accordance with claim 1, wherein each of the tracks is provided with a plurality of juxtaposed suspension members for suspending a plurality of shade cloths.

3. The roman shade in accordance with claim 1, wherein each of the tracks is integrally formed with the respective suspension member.

4. The roman shade in accordance with claim 1, wherein each of the tracks is provided with a plurality of protruding bosses rested on a side of the headrail.

5. The roman shade in accordance with claim 1, wherein the locking groove of each of the suspension members has an opening facing downward.

6. The roman shade in accordance with claim 1, wherein the locking groove of each of the suspension members has an opening facing sideward.

7. The roman shade in accordance with claim 1, wherein the upper end of the shade cloth is formed with a mounting portion for mounting a shaft which is detachably locked in the locking groove of each of the suspension members.

8. A roman shade, comprising:

a headrail a plurality of tracks each mounted on the headrail;

a plurality of suspension members each mounted on a respective one of the tracks and each having an inside formed with a locking groove; and a shade cloth having an upper end extended through and detachably locked in the locking groove of each of the suspension members;

wherein each of the tracks has an inside formed with a pivot hole, and each of the suspension members is protruded outward from the pivot hole of the respective track and has a periphery provided with an arc-shaped pivot portion pivotally mounted in the pivot hole of the respective track.

* * * * *